United States Patent [19]

Sisco et al.

[11] Patent Number: 4,969,925

[45] Date of Patent: Nov. 13, 1990

[54] SOAP BARS WITH POLYMERIC ADDITIVES

[75] Inventors: Rosemary M. Sisco, Hackensack; Michael I. Hill, Fords; Jane A. Vinzent, Glen Ridge, all of N.J.; Michael P. Aronson, West Nyack, N.Y.; David L. Elliott, Hawthorne, N.J.

[73] Assignee: Chesebrough-Pond's USA Co., division of Conopco, Inc., Greenwich, Conn.

[21] Appl. No.: 340,320

[22] Filed: Apr. 19, 1989

[51] Int. Cl.[5] ..... C11D 17/00

[52] U.S. Cl. ..... 252/134; 252/132

[58] Field of Search ..... 252/134, 132, 174.24, 252/DIG. 16, 117, 108

[56] References Cited

U.S. PATENT DOCUMENTS

| | | | |
|---|---|---|---|
| 2,820,768 | 1/1958 | Fromont | 252/118 |
| 4,517,107 | 5/1985 | Clarke et al. | 252/108 |
| 4,673,525 | 6/1987 | Small et al. | 252/132 |
| 4,741,854 | 5/1988 | Krupa et al. | 252/105 |
| 4,828,752 | 5/1989 | Nagarajan | 252/134 |

FOREIGN PATENT DOCUMENTS

| | | |
|---|---|---|
| 186148 | 7/1986 | European Pat. Off. . |
| 227321 | 7/1987 | European Pat. Off. . |
| 2182383 | 5/1987 | United Kingdom . |

*Primary Examiner*—Paul Lieberman
*Assistant Examiner*—John F. McNally
*Attorney, Agent, or Firm*—Milton L. Honig

[57] ABSTRACT

A toilet bar is provided whose components include from 10 to 70% of a soap, from 0.1 to 3% of a cellulosic polymer, and from 0.1 to 3% of a water-soluble carboxylate polymer. The carboxylate polymer is formed from a mixture of monomers comprising a water-soluble carboxylic containing vinyl monomer and a water-insoluble vinyl monomer, the water-insoluble monomer constituting at least 30 mole % of the polymer.

16 Claims, No Drawings

SOAP BARS WITH POLYMERIC ADDITIVES

BACKGROUND OF THE INVENTION

1. Field of the Invention

The invention relates to soap bars having improved wear rates.

2. The Prior Art

Soap bars which are either transparent or translucent have long been known. There have, however, been several problems associated with such bars. Often, the products are barely translucent. Highly transparent bars are known but these have high rates of wear, especially where the bars are produced by casting methods. Color is a further problem that frequently requires improvement.

One of the first significant reports of clear soap bars is found in U.S. Pat. No. 2,820,768 (Fromont) which first coined the term "neutrogenous" indicating the presence of substantial quantities of acid neutralizing material, i.e. triethanolamine. The compositions of Fromont contain mixtures of 35–40% each of sodium and triethanolammonium soaps and substantial amounts of free triethanolamine. These products, produced by casting, have high rates of wear, are only borderline transparent and have a dark brown color.

U.S. Pat. No. 4,741,854 (Krupa et al.) is also based on triethanolamine casting technology. The patent reports achieving improved color through the use of a combination of sulfur and hydride type reducing agents achieving bars of excellent transparency. The major problem with these bars is, however, that they have a high rate of wear being used up relatively quickly under normal hand washing conditions.

Alternative to the casting technology of Fromont and Krupa et al. is that of high shear working of soap to reduce the size of solid crystals. Size reduction minimizes or even eliminates light scattering by the solid crystals thereby achieving light transmission, i.e. clarity. For instance, U.S. Pat. No. 4,517,107 (Clarke et al.) reports a soap-containing formulation becoming clear through shear working between two mutually displaceable surfaces in an apparatus known as a cavity transfer mixer. While products from this process have excellent wear and are readily manufactured, a translucent rather than a transparent product results.

GB 2 182 383 (Dawson et al.) reports a beta-phase soap which is a mixture of solid soap and water-soluble polymer produced by a milling process. Lather characteristics are said to be much improved by use of the water-soluble polymer with no impairment of clarity. A diverse variety of suitable polymers were disclosed including copolymers derived from acrylic acid and/or methacrylic acid, cationic or nonionic guar gums and copolymers of dimethyldiallyl ammonium chloride/acrylamide and dimethyl aminoethylmethacrylate/acrylamide copolymers. As with all high shear mixing processes, the bars of Dawson et al. although claiming transparency are in fact at best only translucent. Similar types of polymers are incorporated into syndet bars, as reported in U.S. Pat. No. 4,673,525 (Small et al.), to improve skin feel and as a mildness aid.

EP 0 186 148A2 (Nagarajan) provides another report of milled syndet bars thickened with water-swellable or water-soluble homo- and co-polymers incorporating acrylic acid. Improvements in humectancy, lather and cracking are noted. There is no indication given that any of these polymers are particularly suitable for reduction of wear in clear bars, especially those produced through casting.

Accordingly, it is an object of the present invention to provide a soap bar having phase homogeneity and low wear rates.

Another object of the present invention is to provide a soap bar of phase homogeneity and low wear rate that can be produced in a casting process employing a low viscosity soap solution.

These and further objects and advantages will become more apparent in the further description of the present invention.

SUMMARY OF THE INVENTION

A toilet bar is provided comprising:

(i) from about 10 to about 70% by weight of a $C_8$–$C_{22}$ fatty acid salt;

(ii) from about 0.1 to about 3% by weight of a cellulosic polymer; and (iii) from about 0.1 to about 3% by weight of a water-soluble carboxylate polymer formed from a mixture of monomers comprising a water-soluble carboxylic containing vinyl monomer and a water-insoluble vinyl monomer, said water-insoluble vinyl monomer constituting at least 30 mole % of the polymer.

Compositions of this invention advantageously are prepared as a soap solution of low viscosity which is optically isotropic and non-birefringent. Both types of polymers are added to the isotropic soap solution prior to hardening of the bar. The combination of polymers from the cellulosic and carboxylate classes provides a significant improvement in rate of wear over each of the polymers individually while retaining a high degree of phase homogeneity.

DETAILED DESCRIPTION OF THE INVENTION

According to the present invention, soap bar compositions of improved wear rates are obtainable by incorporation of a selected polymeric system within the bar. The system requires polymers selected from at least two different classes. These two classes of polymers synergistically interact to lower the bar's rate of consumption but otherwise do not adversely impact upon phase homogeneity or washing effectiveness.

The first type of polymer found necessary is a water-soluble cellulosic material modified with either cationic or hydrophobic groups. Illustrative of this first category or Type A are the hydroxyalkyl alkylcellulose ethers, wherein the alkyl chain may vary from 1 to 18 carbons. Among the most preferred Type A polymers are methylcellulose, hydroxyethyl ethylcellulose and hydropropyl methylcellulose ethers.

Under Type A there may be employed cationic cellulosic polymers. Examples of such materials are hydroxypropyl trimethylammonium guar gum available under the trademark Jaguar® from Hoechst-Celanese Corporation and quaternary ammonium substituted cellulose ethers available under the trademark Polymer JR® and Celquat® from Amerchol and National Starch Corporation, respectively.

The second or Type B polymer necessary is a water-soluble carboxylate polymer formed from a mixture of monomers which includes both a water-soluble carboxylic containing vinyl monomer and a water-insoluble vinyl monomer. The former promotes water-solubility or at least aqueous dispersibility by the carboxylate polymer. This monomer will be a $C_3$–$C_6$ alkanoic monoor di-acid illustrative of which are acrylic acid, methacrylic acid, maleic acid or anhydride, itaconic acid, fumaric acid, mesaconic acid, crotonic acid and combinations thereof. Preferred are monomers of acrylic or methacrylic acids. The carboxylic containing vinyl monomer will normally constitute from 5 to 70 mole % of the polymer.

The second monomer unit found in Type B polymers must promote some degree of hydrophobicity or decreased water solubility to the polymer. When incorporated into the polymer, this component should not readily be hydrated although it may be slightly water-soluble. Illustrative monomers of this variety include $C_1$–$C_{22}$-alkyl acrylates or methacrylates, N-$C_1$ -$C_{22}$ alkyl acrylamides, styrene, vinyl acetate, vinyl chloride, $C_2$–$C_{22}$ olefins, and mixtures thereof. The second monomer unit normally will constitute from at least 30 to 95 mole % of the Type B polymer.

Other monomers may also be included in the Type B polymers to provide various effects in the final properties. For instance, monomers may be employed that can alter the polymer solubility, viscosity or glass transition temperature. Cross-linking agents such as divinylbenzene may be added to impart some degree of gelation or network formation. Polymerizable surfactant groups can be included to alter polymer rheology or associative behavior. Illustrative are polyalkylene oxide blocks pendant from hydroxy or carboxy functionalized monomer units. These further monomers may be present anywhere from 0.1 to 10% of the final Type B polymer.

A further element of the invention is soap, technically referred to as a salt of a $C_8$–$C_{22}$ fatty acid. These fatty acids may be natural or synthetic aliphatic (alkanoic or alkenoic) acid salts. Soaps having the fatty acid distribution of coconut oil may provide the lower end of the broad molecular weight range. Those soaps having the fatty acid distribution of peanut, tallow or rapeseed oil, or their hydrogenated derivatives, may provide the upper end of the broad molecular weight range.

It is preferred to use soaps having the fatty acid distribution of coconut oil or tallow, or mixtures thereof, since these are among the more readily available fats. The proportion of fatty acids having at least 12 carbon atoms in coconut oil soap is about 85%. This proportion will be greater when mixtures of coconut oil and fats such as tallow, palm oil, or non-tropical nut oils or fats are used, wherein the principal chain lengths are $C_{16}$ and higher.

The soaps may contain unsaturation in accordance with commercially acceptable standards. Excessive unsaturation is normally avoided.

Salt oounterions to the fatty acid may be those selected from alkali, ammonium or alkanolammonium ions. The term alkanolammonium refers to one, two or three $C_1$–$C_4$ hydroxyalkyl groups substituted onto a nitrogen cation, the triethanolammonium cation being the species of choice. Suitable alkali metal cations are those of potassium and sodium, the latter being preferred.

Soap, i.e. $C_8$–$C_{22}$ fatty acid salt, will normally be present in amounts ranging from about 10 to 70% by weight. Preferably, the amount of soap will range from about 30 to 50% by weight.

A liquid solvent system is usually also characteristic of compositions covered by the present invention. For purposes of definition, the solvent system must comprise components liquid at room temperature. Water will normally always be a component of the solvent. The amount of water may range from about 5 to about 35% by weight, preferably from about 10 to 25%.

Other than water, the solvent may include such liquids as alkanolamines, $C_1$–$C_3$ alcohols, polyols and mixtures thereof.

Alkanolamines may be present as soap counterions but also as solvent in their "free" state. For purposes of this invention, free alkanolamine refers to any molar excess alkanolamine beyond that which is required for neutralization of any acid present in the bar composition.

Alkanolamine as used throughout this specification is intended to include $C_1$–$C_3$ mono-, di- and tri-alkanolamine species. For example, mono-, di-and/or triethanolamine are suitable for the present invention. Particularly preferred, however, is triethanolamine. When present, the amount of free alkanolamine may range from about 10 to about 40% by weight.

Another component of the solvent system may be a polyol generally defined as a non-volatile di- or higher polyhydric alcohol, a sugar or a polyethylene glycol. Particular examples include propylene glycol, glycerol, sorbitol, sucrose and 400 molecular weight polyethylene glycol; glycerol is however preferred. When present, the amount of polyols will range from about 15 to about 40% by weight. Also desirable is to have a combination of alkanolamine to polyol in the weight ratio of 1:3 to 1:0.25.

Another type of solvent that may be useful for compositions of the present invention are the $C_1$–$C_4$ alcohols. For example, these include ethanol and isopropyl alcohol, with the former being preferred. The amount of alcohol, when present, may range from about 1% to about 25% by weight.

Certain highly transparent forms of the bar may be achieved through careful control of the relative ratios of certain components. Thus, a preferred bar will comprise a mixture of alkanolammonium and alkali metal $C_{12}$–$C_{22}$ fatty acid salts wherein the mole ratio of alkanolammonium to alkali metal fatty acid salt ranges from about 0.1 to less than 1.0. A liquid solvent system will also be present that includes an amount of water and free alkanolamine in a weight ratio ranging from greater than 0.25 to less than 1.0, and wherein the weight ratio of total fatty acid salt to solvent ranges from greater than 0.02 to less than 1.0. A liquid solvent system will also be present that includes an amount of water and free alkanolamine in a weight ratio ranging from greater than 0.25 to less than 1.0, and wherein the weight ratio of total fatty acid salt to solvent ranges from greater than 0.02 to less than 1.0.

Adjunct materials may include germicides, perfumes, electrolytes, preservatives and colorants. These normally will be in amounts less than 10% by weight of the composition, usually less than 5% by weight. Of course, care must be taken that the amount and type of these further additives not cause crystallization of solid soap crystals, dissociation of alkanolammonium cations or other effects which adversely impinge upon phase homogeneity.

Compositions described herein may be prepared by heating and mixing the components until they dissolve. Thereafter, the liquid compositions are allowed to cool and solidify. The mixture should be quiescent during this solidification. Nevertheless, the mixture may be poured into individual molds before cooling and solidification, if desired. It may be particularly desirable for these molds to be transparent.

For purposes of this invention, it is important that the polymers be combined with the soap, solvent and other components to form an isotropic solution prior to hardening of the bar. Prior to hardening, the compositions of this invention should have a viscosity ranging anywhere from 50 cps to 2000 cps at a shear rate of 21 $sec^{-1}$ as measured on a Haake Rotoviscometer at 65° C., preferably between 300 and 800 cps.

High shear processing is neither necessary for the solidified material to become clear nor desirable once solidification has begun as it causes a loss of rigidity in the material. It should also be appreciated that these compositions do not require drying or maturation time to achieve optimal clarity. Polymers of this invention should not be added to highly viscous or solid optioally anisotropio, birefringent soap.

The soap bars covered by the present invention need not be clear; only phase homogeneity is required. Nevertheless, certain of the systems covered by this invention will have good clarity. The term "clear" as used in the specification indicates both transparent and translucent properties. A soap bar is deemed transparent if the maximum transmittance of light of any wavelength in the range of 200 to 800 nm through a sample 10 cm thick is at least 1%. A bar is deemed translucent if the maximum transmittance of such light through the sample is between 0.01% and 1%. Finally, a bar is deemed opaque if the maximum transmittance of such light is below 0.01%; opaque bars are not considered clear within the context of this invention. Transmittance can be easily measured by placing a solid soap sample of the required thickness in the light beam path of a UV-VIS Spectrophotometer such as the Hewlett-Packard 8451A Diode Array Spectrophotometer. The advantage of this method is that it is highly sensitive to optical clarity while independent of color.

An alternative method of determining whether a soap bar is transparent may be found in U.S. Pat. No. 3,274,119 which defines transparency as a composition that allows bold face type of 14 point size to be easily read through a ¼" section of material.

The following examples will more fully illustrate the embodiments of this invention. All parts, percentages and proportions referred to herein and in the appended claims are by weight of the total composition unless otherwise stated.

EXAMPLE 1

A formulation typical of the present invention is found in Table I.

TABLE I

| Component | Weight % Concentration |
|---|---|
| Triethanolamine | 49.7 |
| Tallow/Coconut (82/18) Soap* | 22.87 |
| Stearic Acid | 6.4 |
| Coconut Fatty Acid | 4.7 |
| Sodium Bisulfite | 0.43 |
| Sodium Borohydride | 0.002 |
| Butyl Hydroxyanisole | 0.19 |
| Cellulosic Polymer | 0–2 |
| Carboxylate Polymer | 0–2 |
| Water | Balance |

*Includes 13% water.

Formulation of Polymer (Alcogum SL-98) into Bar

The following is a standard method for formulating polymeric materials into phase homogeneous soap bars:

Into a 2-liter kettle equipped with mechanical stirrer and jacketed heating mantle were placed 526.5 g of triethanolamine (TEA), 67.5 g of stearic acid, and 49.6 g of coconut fatty acid (Emery 625®). The kettle was sealed and its contents heated to 60°–70° C. With continued stirring, a premix of 0.45 g of sodium bisulfite (ex Fisher) and 0.22 g of sodium borohydride (ex Aldrich) were dissolved in 5.0 g of water, and then added to the kettle. The contents melted and became transparent with a pale yellow color. Next, 245.56 g of 82/18 tallow coconut soap (Na salt) and 2.0 g of butylhydroxyanisole (BHA, ex Kodak) were added to the kettle. When these ingredients were dispersed thoroughly, 34.5 g of the polymer (Alcogum SL-98, an associative thickener which comes as a 30 wt % alkali-soluble aqueous emulsion) was diluted with the remaining water (138.08 g) and added to the mixture. Once the solution became transparent, the soap was transferred to a mold.

EXAMPLE 2

A series of polymeric materials were tested for compatibility in the bar formulation of Example 1. These results are summarized in Table II. The Table demonstrates that soap with only certain polymers remains phase homogeneous; this is due to polymer structure and content.

TABLE II

Compatibility of Polymers with the Bar Formula

| Polymeric Material | Supplier | Description | Appearance |
|---|---|---|---|
| PPE-1042 ® | National Starch Co. | Cross-linked Methacrylic acid/ Butylacrylate | Homogeneous |
| PPE-1068 ® | National Starch Co. | Cross-linked Methacrylic acid/ Butylacrylate | Homogeneous |
| PPE-1069 ® | National Starch Co. | Cross-linked Methacrylic acid/ Butylacrylate | Homogeneous |
| Acrysol ASE-60 ® | Rohm & Haas | Cross-linked Styrene/Methacrylic Acid/Ethyl Acrylate | Homogeneous |
| Acrysol ASE-75 ® | Rohm & Haas | Cross-linked Styrene/Methacrylic Acid/Ethyl Acrylate | Phase Separation |
| Alcogum SL-65 ® (SL-98) | Alco | Methacrylic Acid/ Alkyl Acrylate/ Surfactant Monomer | Homogeneous |

TABLE II-continued

| Compatibility of Polymers with the Bar Formula | | | |
|---|---|---|---|
| Polymeric Material | Supplier | Description | Appearance |
| Alcogum SL-70 ® | Alco | Methacrylic Acid/ Alkyl Acrylate/ Surfactant Monomer | Homogeneous |
| Acrysol ICS-1 ® | Rohm & Haas | Methacrylic Acid Alkyl Acrylate/ Surfactant Monomer | Homogeneous |
| Natrosol Plus ® | Aqualon | Modified hydroxy-ethylcellulose | Homogeneous |
| Polymer JR-400 ® | Amerchol | Cationic Cellulose | Homogeneous |
| LM-200 ® | Amerchol | Cationic Cellulose | Homogeneous |
| Celquat 240 ® | National Starch Co. | Cationic Cellulose | Homogeneous |
| Carbopol 615 ® | B. F. Goodrich | Polyacrylate | Phase Separation |
| Carbopol 1342 ® | B. F. Goodrich | " | Phase Separation |
| Carbopol 1720 ® | B. F. Goodrich | " | Phase Separation |
| Hostacerin PN73 ® | American Hoechst | Polyacrylamide | Phase Separation |

EXAMPLE 3

The following procedure is typical of the manner in which Type A and B polymers were placed into the base formulation of Table I. A bar was formulated that contained 0.4% Polymer JR-400 ® and 1.6% Alcogum SL-98 ®.

Four grams of Polymer JR-400 ® (ex Amerchol) were added to 526.5 grams of TEA in a 2-liter resin kettle and dispersed well with a mixer at 23° C.. Next, 67.5 grams stearic acid and 49.6 grams of Emery 625 ® were added to the TEA/polymer mixture. The kettle was then sealed and heated to 60° C.. With continued stirring, a premix of 0.45 grams of sodium bisulfite, 0.02 grams of sodium borohydride, and 5.0 grams of water was prepared and added to the kettle. Once the solution was clear, 214.50 grams of tallow/coconut (82/18) soap containing 2% water and 2.0 grams of BHA were added. Finally, a premix of 193.28 grams of water and 53.3 grams of Alcogum SL-98 ® (30% aqueous dispersion) were added to the kettle. Stirring continued until the solution became clear. The kettle was removed from the heat and the contents (which were a light yellow color) were poured into a plastic mold and cooled at 23° C. for several hours (until hardened). The molded soap was then cut into bars.

The rate of wear of the different bars was measured using the following procedure:

The soap bars were stamped to ensure uniform size and shape by placing four bars into the stamping molds. Molding the soap from flat to convex bars was accomplished by manual cranking of the press. Each bar then was measured for length, width, depth, and initial mass. Each bar was then submerged mid-length into water at 95° F. for 30 minutes. Afterwards, each bar was weighed. Then, the "mush" layer of the bar was scraped away with a toothbrush handle followed by reweighing of the bar. The bar was air dried at 24 hours and the final mass determined. The rate of dissolution or % mass loss was calculated for each bar. Each series tested consisted of four bars containing polymer, and a control with no polymer.

In Table III, the % improvement for several polymers and polymer combinations is shown. The term "% improvement" is defined in the following way:

$$\% \text{ Improvement} = \frac{\% \text{ mass loss (control)} - \% \text{ mass loss (experimental)} \times 100}{\% \text{ mass loss (control)}}$$

where the control is the bar containing no polymer, and the experimental is the bar containing the polymer or combinations of polymers.

Table III illustrates the synergistic effects obtainable by combinations of Type A and B polymers in soap formulations.

TABLE III

| Combinations of Polymers in Soap Formulations | | | |
|---|---|---|---|
| | Polymeric Additive(s) | Appearance of Bar | % Wear Rate Improvement |
| Control: | None | Homogeneous | 0 |
| | 0.4% Polymer JR-400 ® [1] | Homogeneous | 6.1 |
| Test 1: | 0.4% Alcogum SL-70 ® | Homogeneous | 17.5 |
| | 0.2% Polymer JR ®, 0.2% Alcogum ® | Homogeneous | 30.1 |
| | 0.5% Amerchol LM-200 ® [1] | Homogeneous | 9.5 |
| Test 2: | 0.5% Alcogum SL-70 ® | Homogeneous | 7.5 |
| | 0.25% Amerchol ®, 0.25% Alcogum ® | Homogeneous | 15.2 |
| | 0.4% Polymer JR-400 ® | Homogeneous | 6.1 |
| Test 3: | 0.8% Alcogum SL-98 ® [2] | Homogeneous | 0 |
| | 0.2% Polymer JR ®, 0.4% Alcogum ® | Homogeneous | 11.6 |
| | 0.4% Amerchol LM-200 ® | Homogeneous | 9.9 |
| Test 4: | 0.4% PPE-1042 ® [3] | Homogeneous | 9.9 |
| | 0.2% Amerchol ®, 0.2% PPE-1042 ® | Homogeneous | 16.9 |
| | 1% Amerchol LM-200 ® | Homogeneous | 13.4 |
| Test 5: | 1% PPE-1042 ® | Homogeneous | 23.3 |
| | 0.5% Amerchol ®, 0.5% PPE-1042 ® | Homogeneous | 31.8 |
| | 3% Amerchol LM-200 | Phase Separation | NM |
| Test 6: | 3% PPE-1042 ® | Severe Phase Separation | NM |

TABLE III-continued

| Combinations of Polymers in Soap Formulations | | |
|---|---|---|
| Polymeric Additive(s) | Appearance of Bar | % Wear Rate Improvement |
| 1.5% Amerchol ®, 1.5% PPE-1042 ® | Homogeneous | 48.0 |

NM — Not measurable because phase separation prevented molding of bars with reproducible composition and properties.
[1] Polymer JR-400 ® and Amerchol LM-200 ® are cationically-modified cellulosics of molecular weight 400,000 both available from Amerchol, Inc.
[2] The Alcogums are terpolymers of methacrylic acid (40–50%), methyl methacrylate or alkyl acrylate (40–50%), and a polymerizable surfactant monomer (app. 1%). They are sold by Alco Chemical Co. as 30% dispersions in water.
[3] PPE-1042 ® is an alkali-soluble emulsion sold as a 30% solids dispersion in water by National Starch and Chemical Co. It contains about 40–50% butyl acrylate and about 40–50% methacrylic acid with a small amount of a cross-linking monomer.

The results in Table III indicate that at constant amounts of polymer in the formula, combinations of two polymers, one from each of the selected types, show a synergistic improvement in rate of wear over individual polymers.

EXAMPLE 4

The following experiments were conducted to correlate physical properties of bar hardness and viscosity in various of the polymer-containing soap compositions. Table IV lists these results.

TABLE IV

| Total Polymer Conc. | Type A Polymer | Type B (see below) | % Wear Rate Improvement | Viscosity (65 C,21/s) |
|---|---|---|---|---|
| 0 (wt %) | 0 | 0 | 0 | 460cp |
| 0.5 | 0.5 | 0 | 9.5 | 380 |
| 0.5 | 0 | 0.5 AT | 7.5 | 410 |
| 0.5 | 0.25 | 0.25 AT | 15.2 | 410 |
| 1.0 | 1.0 | 0 | 13.4 | 500 |
| 1.0 | 0 | 1.0 EP | 23.3 | 520 |
| 1.0 | 0.5 | 0.5 EP | 31.8 | 560 |
| 2.0 | 2.0 | 0 | 35.6 | 500 |
| 2.0 | 0 | 2.0 AT | * | * |
| 2.0 | 1.0 | 1.0 AT | 32.1 | 640 |
| 3.0 | 3.0 | 0 | * | * |
| 3.0 | 0 | 3.0 EP | * | * |
| 3.0 | 1.5 | 1.5 EP | 48.0 | 1800 |

Type A (Cellulosics): Amerchol LM-200 ® (Amerchol).
Type B AT = Alcogum SL-70 ® (Alco), EP = PPE-1042 ® (National Starch).
*Polymer was incompatible in the soap formulation, resulting either in phase separation or in homogeneity. This prevented molding of bars with reproducible composition and properties.

Table IV indicates that there is some correlation between the viscosity and % wear rate improvement for each total polymer concentration.

The foregoing description and Examples illustrate selected embodiments of the present invention. In light thereof, various modifications will be suggested to one skilled in the art all of which are within the spirit and purview of this invention.

What is claimed is:

1. A toilet bar comprising:
(i) from about 10 to about 70% by weight of a $C_8$–$C_{22}$ fatty acid salt;
(ii) from about 0.1 to about 3% by weight of a cationic cellulosic polymer; and
(iii) from about 0.1 to about 3% by weight of a water-soluble arboxylate polymer formed from a mixture of monomers comprising a water-soluble carboxylic containing vinyl monomer and a water-insoluble vinyl monomer, said water-insoluble monomer consisting at least 30 mole %.of the polymer.

2. A composition according to claim 1 wherein the water-soluble carboxylic vinyl monomer is selected from the group consisting of acrylic acid, methacrylic acid, maleic acid, itaconic acid, fumaric acid, crotonic acid and mixtures thereof.

3. A composition according to claim 1 wherein the water-insoluble vinyl monomer is selected from the group consisting of $C_1$–$C_{22}$—alkyl acrylates or methacrylates, N—$C_1$–$C_{22}$ alkyl acrylamides, styrene, vinyl acetate, vinyl chloride, $C_2$–$C_{22}$ olefins, and mixtures thereof.

4. A composition according to claim 1 wherein the cellulosic polymer is present in an amount from about 0.2 to 1.5% by weight.

5. A composition according to claim 1 wherein the carboxylate polymer is present in an amount from about 0.2 to 1.5% by weight.

6. A composition according to claim 1 wherein polymers (ii) and (iii) are added to an isotropic solution of the fatty acid salt prior to hardening of the bar.

7. A composition according to claim 6 wherein said isotropic solution containing said polymers, prior to hardening, will have a viscosity ranging from about 50 cps to about 2,000 cps at a shear rate of 21 $sec^{-1}$ as measured on a Haake Rotoviscometer at 65° C.

8. A composition according to claim 7 wherein said viscosity ranges between 300 and 800 cps.

9. A composition according to claim 1 further comprising from about 5 to about 35% by weight of water.

10. A composition according to claim 1 further comprising from about 10 to 40% by weight of an alkanolamine.

11. A composition according to claim 1 further comprising from about 15 to about 40% by weight of a polyol.

12. A composition according to claim 1 further comprising from about 1% to about 25% by weight of a $C_1$–$C_4$ alcohol.

13. A composition according to claim 1 having a transmittance of at least 0.01% of light of any wavelength in the range 200 to 800 nm through a sample 10 cm thick.

14. A composition according to claim 13 wherein said transmittance is at least 1%.

15. A composition according to claim 1 wherein said cationic cellulosic polymer is a hydroxypropyl trimethylammonium guar gum.

16. A composition according to claim 1 wherein said cationic cellulosic polymer is a quaternary ammonium substituted cellulose ether.

* * * * *

UNITED STATES PATENT AND TRADEMARK OFFICE

CERTIFICATE OF CORRECTION

PATENT NO. : 4,969,925

DATED : November 13, 1990

INVENTOR(S) : Rosemary M. Sisco; Michael I. Hill; Jane A. Vinzent; Michael P. Aronson; David L. Elliott It is certified that error appears in the above—identified patent and that said Letters Patent is hereby corrected as shown below:

ON TITLE PAGE:

Change the Assignee designation from "Chesebrough-Pond's USA Co., division of Conopco, Inc., Greenwich, Conn." to --Lever Brothers Company, New York, New York--.

Signed and Sealed this

Fifteenth Day of September, 1992

*Attest:*

DOUGLAS B. COMER

*Attesting Officer*

*Acting Commissioner of Patents and Trademarks*